US007765836B2

(12) United States Patent
Lonati et al.

(10) Patent No.: US 7,765,836 B2
(45) Date of Patent: Aug. 3, 2010

(54) CIRCULAR KNITTING MACHINE FOR HOSIERY OR THE LIKE

(75) Inventors: Ettore Lonati, Botticino (IT); Tiberio Lonati, Brescia (IT); Fausto Lonati, Brescia (IT); Jan Ando, Brno (CZ)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 12/225,912

(22) PCT Filed: Mar. 27, 2007

(86) PCT No.: PCT/IB2007/000891

§ 371 (c)(1),
(2), (4) Date: Sep. 15, 2009

(87) PCT Pub. No.: WO2007/113662

PCT Pub. Date: Oct. 11, 2007

(65) Prior Publication Data

US 2010/0011816 A1 Jan. 21, 2010

(30) Foreign Application Priority Data

Mar. 31, 2006 (IT) ..... MI2006A0628
Jul. 14, 2006 (IT) ..... MI2006A1378

(51) Int. Cl.
*D04B 9/00* (2006.01)

(52) U.S. Cl. ..... 66/216; 66/78

(58) Field of Classification Search ..... 66/7, 66/8, 17, 18, 123, 215–221, 78, 214
See application file for complete search history.

(56) References Cited

U.S. PATENT DOCUMENTS 3,678,710 A 7/1972 Ando
4,073,163 A * 2/1978 Lonati ..... 66/14
5,275,021 A * 1/1994 Fucik ..... 66/57
5,367,893 A * 11/1994 Fucik ..... 66/222
5,520,024 A 5/1996 Ando
6,220,061 B1 4/2001 Ando
2003/0101775 A1 6/2003 Ando

FOREIGN PATENT DOCUMENTS

| | | |
|---|---|---|
| EP | 0 677 605 | 1/1999 |
| EP | 1 010 790 | 6/2000 |
| WO | WO 02/42536 | 5/2002 |

OTHER PUBLICATIONS

International European Search report for PCT/IB2007/000891.

* cited by examiner

*Primary Examiner*—Danny Worrell
(74) *Attorney, Agent, or Firm*—Husch Blackwell Sanders LLP

(57) ABSTRACT

A circular knitting machine for hosiery or the like, comprising a needle cylinder with vertical axis and multiple axial surface slots, each of which accommodates a needle and an actuation element for the needle. The actuation element comprises at least one connecting element. The connecting element is provided with a radially extractable movable heel, that engages connecting element actuation cams facing the lateral surface of the needle cylinder. The cams comprise at least one extraction cam or one retraction cam, which has a portion whose profile is inclined with respect to an ideal plane perpendicular to the axis of the needle cylinder. The machine comprises extraction means causing extraction of the movable heel and keeping thereof in extracted position over the entire extension of the portion having an inclined profile of the extraction cam or of the retraction cam.

18 Claims, 4 Drawing Sheets

CIRCULAR KNITTING MACHINE FOR HOSIERY OR THE LIKE

TECHNICAL FIELD

The present invention relates to a circular knitting machine for hosiery or the like.

BACKGROUND ART

Single-cylinder and double-cylinder circular knitting machines for hosiery or the like are known.

Single-cylinder circular machines comprise substantially a needle cylinder which has a vertical axis and on the lateral surface of which there are a plurality of axial slots, each of which accommodates a needle which can be actuated with an alternating motion along the corresponding axial slot in order to form knitting. The needle is provided generally with a heel which protrudes radially from the corresponding axial slot of the needle cylinder, and the needle is actuated by providing a plurality of needle actuation cams which are arranged around the needle cylinder and define, as a whole, paths which are shaped with rising portions, parking or horizontal portions, and descending portions, which can be followed by the heel of the needles when the needle cylinder is actuated with a rotary motion about its own axis with respect to the needle actuation cams.

Double-cylinder circular knitting machines for hosiery generally comprise a lower needle cylinder, which has a vertical axis, and an upper needle cylinder, which is arranged above and coaxially with respect to the lower needle cylinder, said cylinders being actuatable rigidly with each other with a rotary motion about the common axis.

A plurality of axial slots are formed on the lateral surface of the lower needle cylinder and on the lateral surface of the upper needle cylinder. The axial slots of the upper needle cylinder are aligned with the axial slots of the lower needle cylinder. A slider is accommodated in each of the axial slots of the lower needle cylinder and in each of the axial slots of the upper needle cylinder. Between the two needle cylinders, i.e., in the knitting region, in each of the axial slots there is a needle which is provided with two tips or heads, respectively an upper head and a lower head; depending on whether one wishes to provide plain stitches or purl stitches, said needle is moved into the lower needle cylinder so that it knits with its upper tip or into the upper needle cylinder so that it knits with its lower tip.

Since the needle does not have a heel, it is actuated by means of the slider arranged in the lower needle cylinder or by means of the slider arranged in the upper needle cylinder, depending on whether it has to form plain or purl stitches.

The sliders currently used in double-cylinder circular knitting machines for hosiery or the like are constituted generally by an elongated laminar body, which has a first longitudinal side designed to rest on the bottom of the axial slot formed on the lateral surface of the lower needle cylinder or on the lateral surface of the upper needle cylinder.

Said sliders are further provided with two heels, which are mutually spaced along the longitudinal extension of the slider and protrude transversely from a second longitudinal side of the slider which lies opposite the first longitudinal side.

Such heels are used to produce the movement of the slider along the corresponding axial slot of the lower or upper needle cylinder so as to produce the actuation of the needle associated with said slider in the various types of knitting of the machine or to transfer the needle from one needle cylinder to the other.

The slider is further provided, on its first longitudinal side, i.e., on its side directed toward the bottom of the axial slot within which it is accommodated, with a hook-shaped tab, which engages the lower head of the needle or the upper head depending on whether the slider is in the lower needle cylinder or in the upper needle cylinder.

Around the lateral surface of the lower needle cylinder and around the lateral surface of the upper needle cylinder there are a plurality of slider actuation cams, which define a series of paths with which the heels of the sliders engage when the needle cylinders are actuated with a rotary motion about their axis with respect to said cams. The paths defined by the cams are shaped so as to cause the movement of the sliders along the axial slots of the needle cylinders in which they are accommodated and consequently cause the actuation of the needles that are associated therewith.

In order to vary the actuation of each needle and therefore vary the type of knitting that the needle produces, it is necessary to actuate the transfer of its heel, or of the heel of the slider that actuates it, from one path to another path of the corresponding actuation cams, and this is achieved generally by providing, inside each axial slot, below the needle in single-cylinder circular machines or below the slider in the lower needle cylinder in double-cylinder circular machines, a sub-needle or selector, which is also provided with one or more heels which can protrude radially from the lateral surface of the needle cylinder in order to engage selector actuation cams which are also arranged around the lateral surface of the needle cylinder in single-cylinder circular machines or of the lower needle cylinder in double-cylinder circular machines.

The selectors can generally oscillate on the radial plane of the needle cylinder on which they lie in order to pass from an active position, in which they protrude from the corresponding axial slot of the needle cylinder or of the lower needle cylinder with at least one of their heels so as to engage the selector actuation cams, to an inactive position, in which they are embedded with their heel or heels within the corresponding axial slot so as not to engage the selector actuation cams, or vice versa.

The selector actuation cams have rising portions and descending portions so as to cause, as a consequence of the rotation of the needle cylinder about its own axis with respect to the selector actuation cams, when a heel of a selector engages them, the rising movement of the needle or of the slider that lies above in order to produce its direct actuation or the transfer of its heel from one path to another among the paths defined by the needle actuation cams or by the slider actuation cams or to allow the descending movement of the needle or of the slider which is usually caused by the needle actuation cams or by the slider actuation cams.

The selectors currently used in circular knitting machines for hosiery are of two kinds: rigid oscillating selectors and elastic oscillating selectors.

Rigid oscillating selectors require an intervention on the selector both to produce their transfer from the active position to the inactive position and to produce their transfer from the inactive position to the active position.

Elastic oscillating selectors generally require an intervention only to produce their transfer from the active position to the inactive position, since the reverse transfer occurs automatically as a consequence of the elastic reaction of the selector as soon as actions thereon to keep it in the inactive position cease.

The transfer of the selectors from the active position to the inactive position is actuated by means of selection devices which laterally face the needle cylinder of the machine and which, by means of the selectors, are capable of varying the actuation of the needles and therefore of varying the knitting that can be produced.

In currently commercially available circular machines, very often, between the needle actuation cams and between the slider actuation cams there are also additional cams which can move on command along a radial direction with respect to the needle cylinder, so as to pass from an active position, in which they are close to the needle cylinder in order to be engaged by the heels of the needles or of the sliders, to an inactive position, in which they are spaced from the needle cylinder so as to not interfere with the heels of the needles or of the sliders and vice versa.

In known types of machine, the engagement of rigid selectors with the selector actuation cams, particularly with the rising portions of said cams which lift the needle or slider, is not always satisfactory, since as a consequence of random phenomena, such as for example vibrations, the heel of the selector can detach from the actuation cam, with the consequence of inaccurate or completely incorrect actuation of the needle. As a consequence of this fact, breakages or knitting errors can occur.

In order to try to solve this problem, the heel of the selectors that is designed to engage the selector actuation cams has been given a trapezoidal shape and the profile of the cams with which it is designed to mate has been shaped correspondingly, but this solution does not offer adequate assurances of strength of the mating, since in the presence of high actuation speeds and intense vibration the accidental disengagement of the selectors from the selector actuation cams can still occur.

For oscillating selectors of the elastic type, this problem is felt less strongly, since the elastic reaction of the selectors strengthens their engagement with the selector actuation cams, but there are greater problems as regards the management of the selectors as a whole, since it is necessary to provide additional actuators or cams at the regions where the selectors are to be brought in the inactive position in order to avoid their engagement with the selector actuation cams, increasing considerably the complexity of the machine.

Moreover, the presence, between the needle actuation cams and the slider actuation cams, of movable cams and of the corresponding actuators, which is necessary in order to produce the various kinds of knitting, has the problem of increasing considerably the complexity of the structure of the entire machine.

Moreover, the presence of these movable cams forces the provision, on board the machine, of an appropriately provided actuation program, which intervenes if an accidental stop of the machine occurs due to a failure of the electric power supply and restores the correct position of the movable cams before knitting resumes, since if the machine were to restart without first restoring the correct position of the movable cams the heels of the needles or of the sliders might break.

In practice, the presence of these movable cams makes it necessary to provide the machine with electronic programs which store the position of the movable cams when the electric power supply is interrupted, and this constitutes a further complication in the production of the machine.

DISCLOSURE OF THE INVENTION

The aim of the present invention is to solve the problems described above by providing a circular knitting machine for hosiery or the like which ensures high precision in the actuation of the needles even in the presence of high actuation speeds and/or of vibrations.

Within this aim, an object of the invention is to provide a machine in which the set of needle or slider actuation cams is simplified considerably with respect to known types of machine.

Another object of the invention is to provide a circular knitting machine for hosiery or the like which can work correctly with a limited number of movable cams, or none at all, for the actuation of the needles or of the sliders.

Another object of the invention is to provide a machine which, despite a simplification of the needle or slider actuation cams, still allows to perform the usual types of knitting that are possible in circular knitting machines for hosiery or the like of the traditional type.

This aim and these and other objects, which will become better apparent hereinafter, are achieved by a circular knitting machine for hosiery or the like, which comprises at least one needle cylinder which has a vertical axis and has, on its lateral surface, a plurality of axial slots, each of which accommodates a needle and a needle actuation element, characterized in that said actuation element comprises at least one connecting element, which is provided, on its side directed toward the outside of the needle cylinder, with at least one movable heel; said connecting element being able to oscillate on a radial plane of the needle cylinder for the transfer of said movable heel from an active position, in which said movable heel protrudes radially from the corresponding axial slot of the needle cylinder to engage corresponding connecting element actuation cams which face the lateral surface of the needle cylinder and define paths which can be followed by said movable heel, in the active position, as a consequence of the actuation of the needle cylinder with a rotary motion about its own axis with respect to said connecting element actuation cams, to an inactive position, in which said movable heel is contained in said axial slot of the needle cylinder so as to not engage said connecting element actuation cams, and vice versa; said connecting element actuation cams comprising at least one extraction cam or one retraction cam, which has a portion whose profile is inclined with respect to an ideal plane which is perpendicular to the axis of the needle cylinder and can be engaged by said movable heel in the active position; extraction means being provided which act on said connecting element to transfer its movable heel from said inactive position to said active position and to keep said movable heel of the connecting element in said active position substantially over the entire extension of said portion of the extraction cam or of the retraction cam.

BRIEF DESCRIPTION OF THE DRAWINGS

Further characteristics and advantages of the invention will become better apparent from the description of two preferred but not exclusive embodiments of the machine according to the invention, illustrated by way of non-limiting example in the accompanying drawings, wherein:

FIG. 1 is a schematic axial sectional view of a portion of the needle cylinder of the machine with the movable heel of the connecting element in the inactive position;

FIG. 2 is a schematic axial sectional view of a portion of the needle cylinder of the machine with the movable heel of the connecting element in the active position;

FIG. 3 is a schematic axial sectional view of a portion of the needle cylinder of the machine with the movable heel of the connecting element in the inactive position;

FIG. 4 is a schematic axial sectional view of a portion of the needle cylinders of the machine with the movable heel of the connecting element in the active position;

WAYS OF CARRYING OUT THE INVENTION

Figure 1:
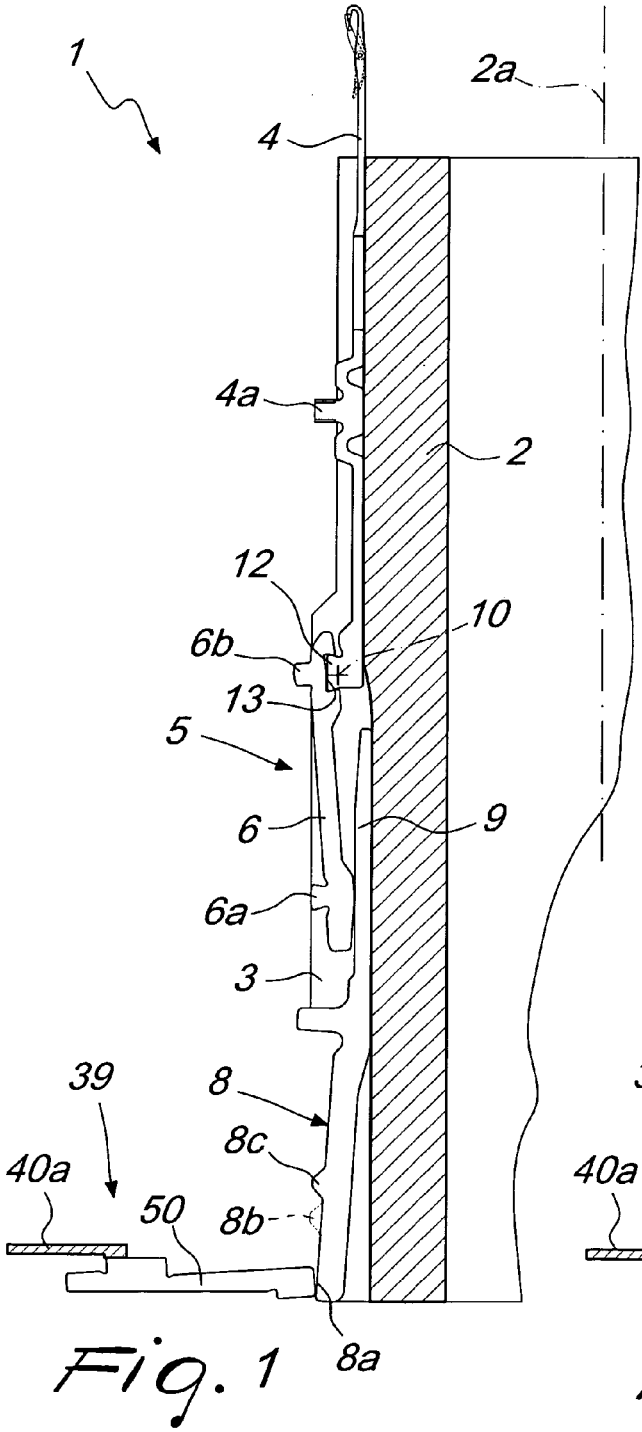
FIGS. 1 and 2 are views of a first embodiment of the machine according to the invention, constituted by a single-cylinder circular knitting machine for hosiery or the like, more particularly.
Figure 2:
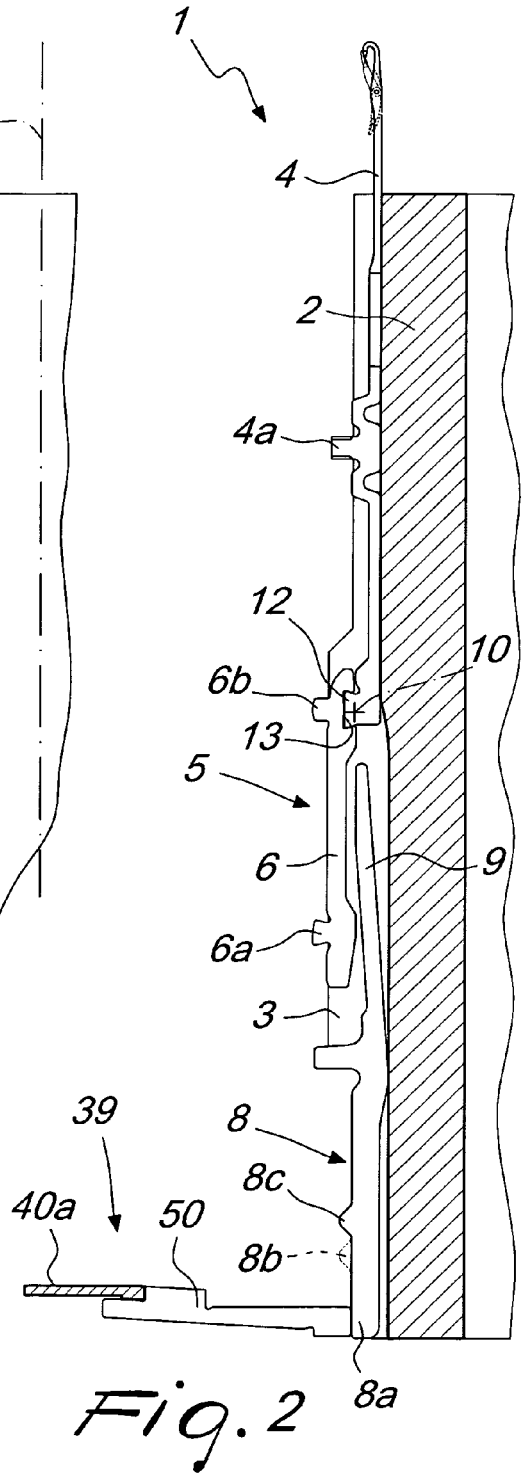

With reference to the first embodiment shown in FIGS. 1 and 2, which refers to a single-cylinder circular knitting machine for hosiery, the machine according to the invention, generally designated by the reference numeral 1, comprises a needle cylinder 2, which has a vertical axis 2*a* and has, on its lateral surface, a plurality of axial slots 3, each of which accommodates a needle 4 and an actuation element 5 for the needle 4.

According to the invention, the actuation element 5 comprises at least one connecting element 6 which is provided, on its side directed toward the outside of the needle cylinder 2, with at least one movable heel 6*a*. The connecting element 6 can oscillate on a radial plane of the needle cylinder 2 in order to cause the transfer of the movable heel 6*a* from an active position, shown in FIG. 2, in which the movable heel 6*a* protrudes radially from the corresponding axial slot 3 of the needle cylinder 2 in order to engage corresponding connecting element actuation cams 7 which face the lateral surface of the needle cylinder 2 and define paths which can be followed by the movable heel 6*a*, in the active position, as a consequence of the actuation of the needle cylinder 2 with a rotary motion about its own axis 2*a* with respect to the connecting element actuation cams 7, to an inactive position, shown in FIG. 1, in which the movable heel 6*a* is contained in the axial slot 3 of the needle cylinder 2 so as to not engage the connecting element actuation cams 7, and vice versa.

The connecting element 6 is pivoted to the longitudinal end of the needle 4 that lies opposite the tip or head of the needle about a pivoting axis 10, which is perpendicular to the radial plane or to the plane of arrangement of the connecting element 6 inserted in the axial slot 3. The connecting element 6 can oscillate about said pivoting axis 10 with respect to the needle 4 in order to produce the transfer of the movable heel 6*a* from the active position to the inactive position or vice versa.

The needle 4 has, in an intermediate region of its longitudinal extension, a fixed heel 4*a* which protrudes radially from the corresponding axial slot 3 of the needle cylinder 2 and can engage needle actuation cams 11 which face the lateral surface of the needle cylinder 2 and define paths which can be followed by the fixed heel 4*a* as a consequence of the actuation of the needle cylinder 2 with a rotary motion about its own axis 2*a* with respect to the needle actuation cams 11.

In the embodiment shown in FIGS. 1 and 2, the connecting element 6 is pivoted directly to the needle 4, but it might be pivoted to an intermediate element arranged between the connecting element 6 and the needle 4, which are arranged in a same axial slot 3 of the needle cylinder 2. In this case, the intermediate element might be connected to the needle 4, preferably with a bilateral connection, so as to transmit to the needle 4 an alternating movement parallel to the axis 2*a* of the needle cylinder 2. In this case, the connecting element 6 would be pivoted to the intermediate element about a pivoting axis which is perpendicular to the radial plane so as to be able to oscillate about said pivoting axis with respect to the intermediate element for the transfer of the movable heel 6*a* from the active position to the inactive position or vice versa.

The pivoting between the connecting element 6 and the needle 4 or the intermediate element is constituted preferably by a protrusion 12, which protrudes on the side of the needle 4 or intermediate element that is directed in the opposite direction with respect to the bottom of the axial slot 3 in which it is accommodated, and by a seat 13 which accommodates, so that it can rotate about the axis 10, the protrusion 12 and is formed in the connecting element 6.

Preferably, the connecting element 6 has, at its end connected to the needle 4 or intermediate element, a second heel 6*b*, which protrudes radially toward the outside of the needle cylinder 2. This second heel 6*b* protrudes constantly from the lateral surface of the needle cylinder 2 and in the specific case can be used as a grip element of the assembly constituted by the needle 4, by the optional intermediate element and by the connecting element 6 in order to replace it during machine maintenance.

Figure 3:
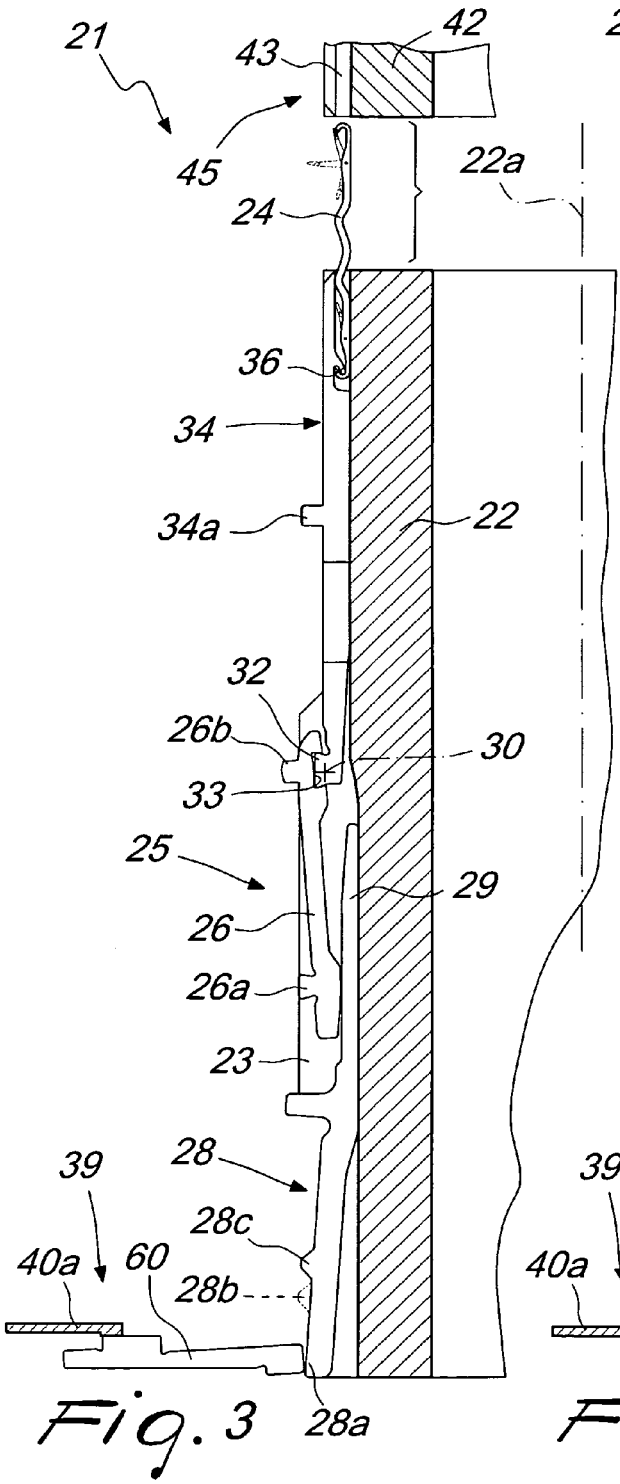
FIGS. 3 and 4 are views of a second embodiment of the machine according to the invention, constituted by a double-cylinder circular knitting machine for hosiery, more particularly.
Figure 4:
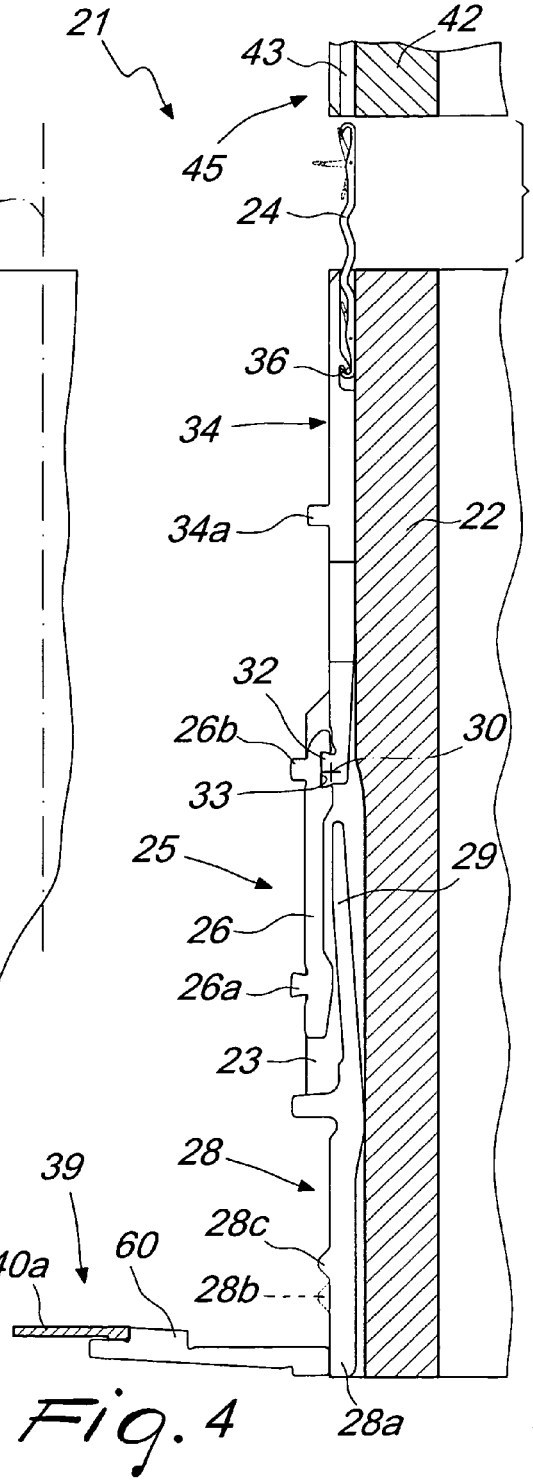

With reference to the second embodiment shown in FIGS. 3 and 4, which refers to a double-cylinder circular knitting machine for hosiery, the machine according to the invention, generally designated by the reference numeral 21, comprises a lower needle cylinder 22, which has a vertical axis 22*a*, and an upper needle cylinder 42, which is arranged upwardly and coaxially with respect to the lower needle cylinder 22. A plurality of mutually aligned axial slots 23, 43 are formed on the lateral surface of the lower needle cylinder 22 and on the lateral surface of the upper needle cylinder 42. An actuation element 25, 45 for a needle 24 is accommodated in each of the axial slots 23, 43 of the lower needle cylinder 22 and of the upper needle cylinder 42, and a needle 24 with a double head or tip is arranged proximate to the mutually facing axial ends of the needle cylinders 22, 42 in one of the needle cylinders 22, 42.

At least the actuation element 25 arranged in the lower needle cylinder 22 comprises a slider 34, which is provided, proximate to one of its longitudinal ends, with means for engaging a head of the needle 24. The actuation element 25 also comprises a connecting element 26, similar to the connecting element 6, which is pivoted to the longitudinal end of the slider 34 that lies opposite the end that can engage the needle 24.

Substantially, the slider 34 can be likened conceptually to the intermediate element considered above in the first embodiment of the machine according to the invention.

More particularly, the slider 34 has, in an intermediate region of its longitudinal extension, a fixed heel 34*a* which protrudes radially from the corresponding axial slot 23 of the lower needle cylinder 22 and can engage slider actuation cams 31 which face the lateral surface of the lower needle cylinder 22 and define paths which can be followed by the fixed heel 34*a* as a consequence of the actuation of the lower needle cylinder 22 with a rotary motion about its own axis 22*a* with respect to said slider actuation cams 31.

The connecting element 26 is provided, on its side directed toward the outside of the lower needle cylinder 22, with at least one movable heel 26*a*. The connecting element 26 can oscillate on a radial plane of the lower needle cylinder 22 in order to cause the transfer of the movable heel 26*a* from an active position, shown in FIG. 4, in which the movable heel 26*a* protrudes radially from the corresponding axial slot 23 of the lower needle cylinder 22 in order to engage corresponding connecting element actuation cams 27 which face the lateral surface of the lower needle cylinder 22 and define paths which can be followed by the movable heel 26*a*, in the active position, as a consequence of the actuation of the lower needle cylinder 22 with a rotary motion about its own axis 22*a* with respect to the connecting element actuation cams 27, to an inactive position, shown in FIG. 3, in which the movable heel 26*a* is contained in the axial slot 23 of the lower needle cylinder 22 so as to not engage the connecting element actuation cams 27, and vice versa.

The connecting element 26 is pivoted to the longitudinal end of the slider 34 that lies opposite the end that can engage the tip or head of the needle 24 about a pivoting axis 30, which is perpendicular to the radial plane or to the plane of arrangement of the connecting element 26 inserted in the axial slot 23. The connecting element 26 can oscillate about said pivoting axis 30 with respect to the slider 34 in order to produce the transfer of the movable heel 26*a* from the active position to the inactive position or vice versa.

The pivoting between the connecting element 26 and the slider 34 is constituted preferably by a protrusion 32, which protrudes on the side of the slider 34 that is directed in the opposite direction with respect to the bottom of the axial slot 23 in which it is accommodated, and by a seat 33 which accommodates, so that it can rotate, the protrusion 32 and is formed in the connecting element 26.

The slider 34 is further provided, proximate to its longitudinal end directed toward the needle 24, with a hook-shaped tab 36, which can engage the corresponding head of the needle 24 and can oscillate on a radial plane of the lower needle cylinder 22 to produce the engagement of the head of the needle 24 or the release of the head of the needle 24 on the part of its hook-shaped tab 36.

Preferably, the connecting element 26 has, at its end connected to the slider 34, a second heel 26*b*, which protrudes radially toward the outside of the lower needle cylinder 22. This second heel 26*b* protrudes constantly from the lateral surface of the lower needle cylinder 22 and can engage corresponding actuation cams which face the lateral surface of the lower needle cylinder 22 and are not shown for the sake of simplicity.

Moreover, said second heel 26*b* can be pressed toward the bottom of the axial slot 23 in order to produce the oscillation of the slider 34 on the radial plane of the needle cylinder 22, on which it lies, in the direction which moves its longitudinal end directed toward the needle 24 away from the bottom of the axial slot 23 of the needle cylinder 22 in which it is accommodated in order to engage or disengage its hook-shaped tab 36 with the corresponding head of the needle 24.

The actuation elements 45 of the needles arranged in the axial slots 43 of the upper needle cylinder 42 are preferably provided like the actuation elements 25 of the needles arranged in the lower needle cylinder 22, i.e., composed, for each axial slot 43, by a slider and by a connecting element which are provided substantially like the slider 34 and the connecting element 26. In a manner similar to what has been described with reference to the lower needle cylinder 22, around the lateral surface of the upper needle cylinder 42 there are slider actuation cams which define paths which can be engaged by the fixed heel of the sliders arranged in the upper needle cylinder 42 and connecting element actuation cams which define paths which can be engaged by the movable heel of the connecting elements pivoted to these sliders. For the sake of simplicity in description, the parts of the machine related to the upper needle cylinder are not shown.

In both illustrated embodiments, the actuation element 5, 25 comprises preferably also a selector 8, 28, which has a portion 9, 29 which protrudes between the connecting element 6, 26 and the bottom of the axial slot 3, 23 of the needle cylinder 2, 22 in which it is accommodated, in any position which can be assumed by the connecting element 6, 26 during the operation of the machine. The selector 8, 28 can oscillate on a radial plane of the needle cylinder 2, 22 in order to cause the oscillation of the connecting element 6, 26 in the direction of oscillation that produces the transfer of the movable heel 6*a*, 26*a* of the connecting element 6, 26 from the inactive position to the active position.

Likewise, the actuation elements 45 of the needles arranged in the axial slots 43 of the upper needle cylinder 42 can comprise, for each axial slot 43, a selector which is similar to the selector 28.

Both in the case of a single-cylinder circular machine and in the case of a double-cylinder circular machine, the connecting element actuation cams 7, 27 for the connecting elements 6, 26 arranged in the single needle cylinder 2 or in the lower needle cylinder 22 and optionally in the upper needle cylinder 42 comprise at least one extraction cam or retraction cam 38, which has a portion 38*a* with a profile which is inclined with respect to an ideal plane which is perpendicular to the axis of the needle cylinder 2, 22, 42 and can be engaged by the movable heel 6*a*, 26*a* in the active position.

According to the invention, the machine comprises extraction means which act on the connecting element 6, 26 to produce the transfer of its movable heel 6*a*, 26*a* from the inactive position to the active position and to keep the movable heel 6*a*, 26*a* in the active position substantially along the entire extension of the portion 38*a* of the extraction cam or of the retraction cam 38.

In both of the embodiments shown, the selector 8, 28 has, in a region of its longitudinal extension which is spaced from its portion 9, 29 which is interposed between the bottom of the axial slot 3, 23 in which it is accommodated and the connecting element 6, 26, at least one region 8*a*, 8*b*, 8*c*, 28*a*, 28*b*, 28*c*, which can be pressed toward the bottom of the axial slot 3, 23 in order to produce the oscillation of the selector 8, 28 and consequently the passage of the movable heel 6*a*, 26*a* of the connecting element 6, 26 from the inactive position to the active position.

In the embodiments shown, each selector 8, 28 has two pressable regions, designated by the reference numerals 8*a*, 8*b* or 8*c* and 28, 28*b* or 28*c* respectively, which are located proximate to the longitudinal end of the selector 8, 28 that lies opposite the longitudinal end thereof directed toward the needle 4 or the slider 34. The pressable regions 8*b*, 8*c* and 28*b*, 28*c* are provided so as to protrude toward the outside of the needle cylinder 2, 22 and are arranged at mutually different heights. More particularly, considering two selectors 8, 28 arranged in two contiguous axial slots 3, 23, a selector 8, 28 is provided with the region 8*b*, 28*b*, while the other selector is provided with the region 8*c*, 28*c*, so as to allow a diversified intervention on the two selectors, as will become better apparent hereinafter.

Said extraction means act on command on the selector 8, 28 to cause its oscillation on the radial plane, so as to actuate the transfer of the movable heel 6*a*, 26*a* of the connecting element 6, 26 from the inactive position to the active position and keep it stably in the active position substantially along the entire extension of the portion 38*a* of the extraction cam or retraction cam 38.

The extraction means comprise an extraction element 39, which faces the lateral surface of the needle cylinder 2, 22, 42 and is arranged at the portion 38*a* of the extraction cam or retraction cam 38. The extraction element 39 acts, preferably by means of the selector 8, 28, on the connecting element 6, 26 to actuate the transfer of the movable heel 6*a*, 26*a* of the connecting element 6, 26 from the inactive position to the active position and to keep it stably in the active position substantially along the entire extension of the portion 38*a* of the extraction cam or of the retraction cam 38.

The extraction element 39 comprises at least one presser 40*a*, 40*b*, 40*c*, which faces the lateral surface of the needle cylinder 2, 22 and can engage the selectors 8, 28 in order to cause their transfer or retention in the position that corresponds to the active position of the movable heel 6*a*, 26*a* of the connecting element 6, 26.

The presser 40*a*, 40*b*, 40*c* can be fixed, i.e., rigidly coupled to the supporting element (also known as cam box) of the actuation cams 11, 31, 7, 27, or can be movable on command along a radial direction with respect to the needle cylinder 2, 22 in order to pass from an activation position, in which it is arranged close to the needle cylinder 2, 22 in order to interfere with the selectors 8, 28, to a deactivation position, in which it is spaced from the needle cylinder 2, 22 so as to not interfere with the selectors 8, 28.

More particularly, in the illustrated embodiments there is a presser 40*a* of the fixed type which belongs to a needle selection device, for example of the type described in patent IT 1312277, which allows needle-by-needle selection, i.e., is capable of actuating independently of each other the various selectors of the machine, in particular even two selectors 8, 28 which are arranged in two contiguous axial slots 3, 23 of the needle cylinder 2, 22.

Said selection device has, for each axial slot 3, 23 of the needle cylinder 2, 22, a lever 50, 60, which is arranged substantially horizontally, is supported by said needle cylinder 2, 22 and can perform a translational motion along a direction which is radial with respect to the needle cylinder 2, 22 and can oscillate on a radial plane of the needle cylinder 2, 22.

The movement of the lever 50, 60 along the radial direction, i.e., toward or away from the axis 2*a*, 22*a* of the needle cylinder 2, 22, is used to act or not act, by means of said lever 50, on the pressable region 8*a*, 28*a* of the selector 8, 28, while the ability of the lever 50, 60 to oscillate on the radial plane is used to produce the transfer of the lever 50, 60 from an active position, in which it has one of its abutment sides, directed in the opposite direction with respect to the needle cylinder 2, 22, at the level of the presser 40*a*, so as to engage it, to an inactive position, in which it has said abutment side arranged below the presser 40*a* so as to not engage it, and vice versa.

The engagement of the lever 50, 60 in the active position with the presser 40*a* produces the translational motion of said lever 50, 60 toward the axis 2*a*, 22*a* of the needle cylinder 2, 22. As a consequence of this translational motion, the lever 50, 60 acts on the pressable region 8*a*, 28*a* of the corresponding selector 8, 28, which by oscillating on a radial plane of the needle cylinder 2, 22 causes, by means of its portion 9, 29, the oscillation of the connecting element 6, 26 which passes with its movable heel 6*a*, 26*a* from the inactive position to the active position.

The presser 40*a* is contoured with an initial guiding portion which gradually approaches the lateral surface of the needle cylinder 2, 22 along the direction of rotation of the needle cylinder 2, 22 about its own axis 2*a*, 22*a* with respect to said presser 40*a*, so as to achieve a gradual engagement of the levers 50, 60 with the presser 40*a*, avoiding excessive impacts or stresses.

As an alternative or as an addition to the presser 40*a*, it is possible to provide other pressers 40*b*, 40*c* which can make contact directly with the selectors 8, 28 in the regions 8*b*, 8*c*, 28*b*, 28*c*.

In this case, by providing for example two types of selector respectively with the region 8*b*, 28*b* or with the region 8*c*, 28*c* and by arranging two pressers 40*b*, 40*c* at the level that corresponds to these regions, it is possible to act in a diversified manner on the selectors of one type or on the selectors of the other type or on both types of selector.

As an alternative, it is possible to provide selection devices of another kind, of a known type, provided with at least one presser which can move on command with respect to the needle cylinder 2, 22, for example along a radial direction, in order to pass from an activation position, in which it interferes with the selectors 8, 28, so as to cause their oscillation and therefore the transfer of the movable heel 6*a*, 26*a* of the connecting element 6, 26 from the inactive position to the active position, to a deactivation position, in which it does not interfere with the selectors 8, 28.

In any case, when one wishes the movable heel 6*a*, 26*a* of a connecting element 6, 26 to engage a portion 38*a* of the extraction or retraction cam 38, in order to produce a lifting or lowering of the needle 4, 24 arranged in the same axial slot 3, 23 of the needle cylinder 2, 22 and engaged directly or by means of the slider 34 with the connecting element 6, 26, the presser or pressers 40*a*, 40*b*, 40*c* act directly or indirectly on the selector 8, 28 so that it keeps the movable heel 6*a*, 26*a* of the connecting element 6, 26 in the active position substantially along the entire extension of the portion 38*a* of the extraction or retraction cam 38.

In this manner, the engagement of the movable heel 6*a*, 26*a* of the connecting element 6, 26 with the extraction or retraction cam 38 is ensured even at high rotation rates and in the presence of vibration.

Figure 5:
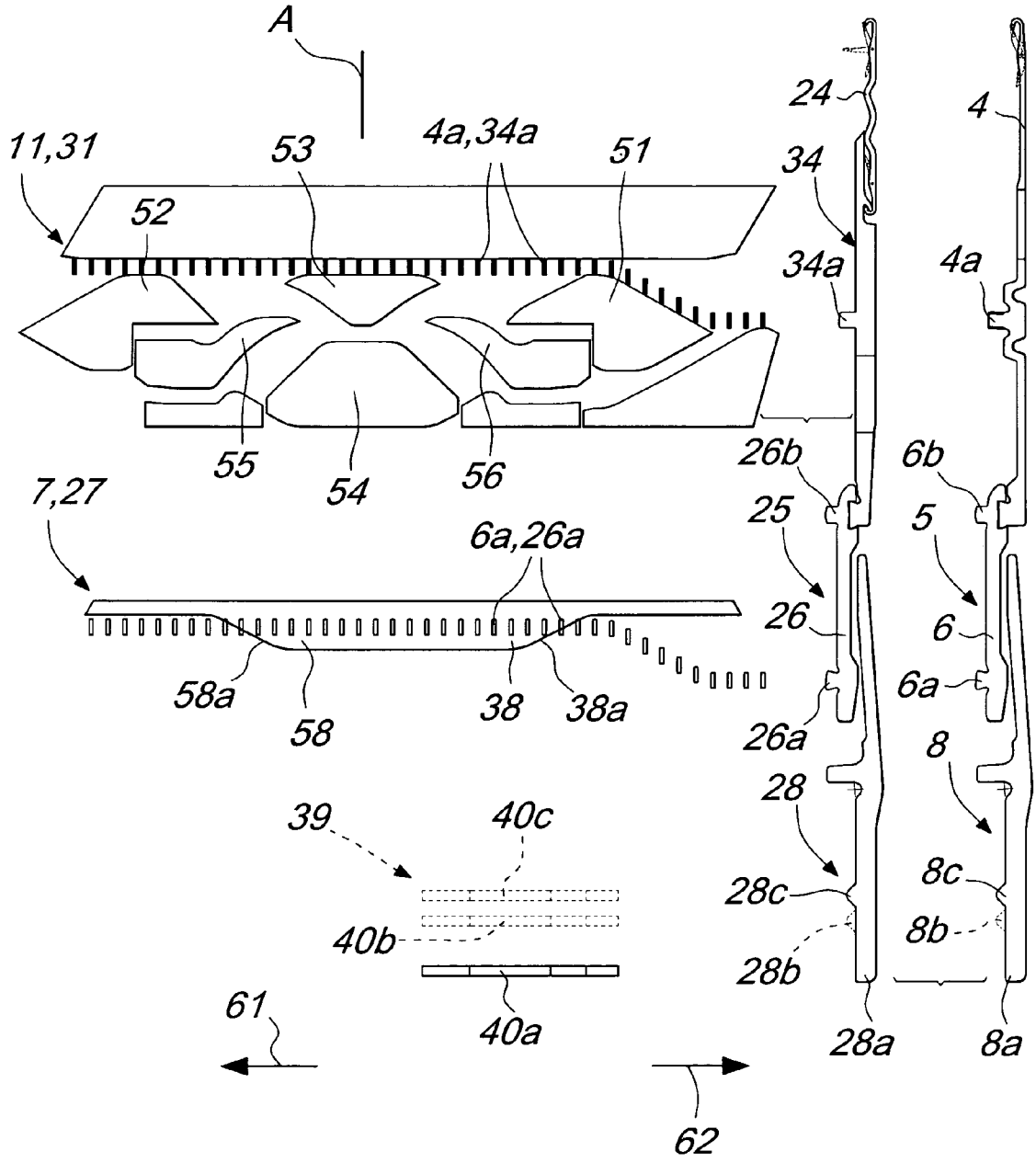
FIG. 5 is a view of a possible embodiment of the set of actuation cams of the needle actuation elements and optionally of the needles, projected flat and taken from its side directed toward the needle cylinder of a single-cylinder circular knitting machine or toward the lower needle cylinder of a double-cylinder circular knitting machine, marking a possible path followed by the heels of the needle actuation elements and optionally of the needles at a feed or drop of the machine.
Figure 6:
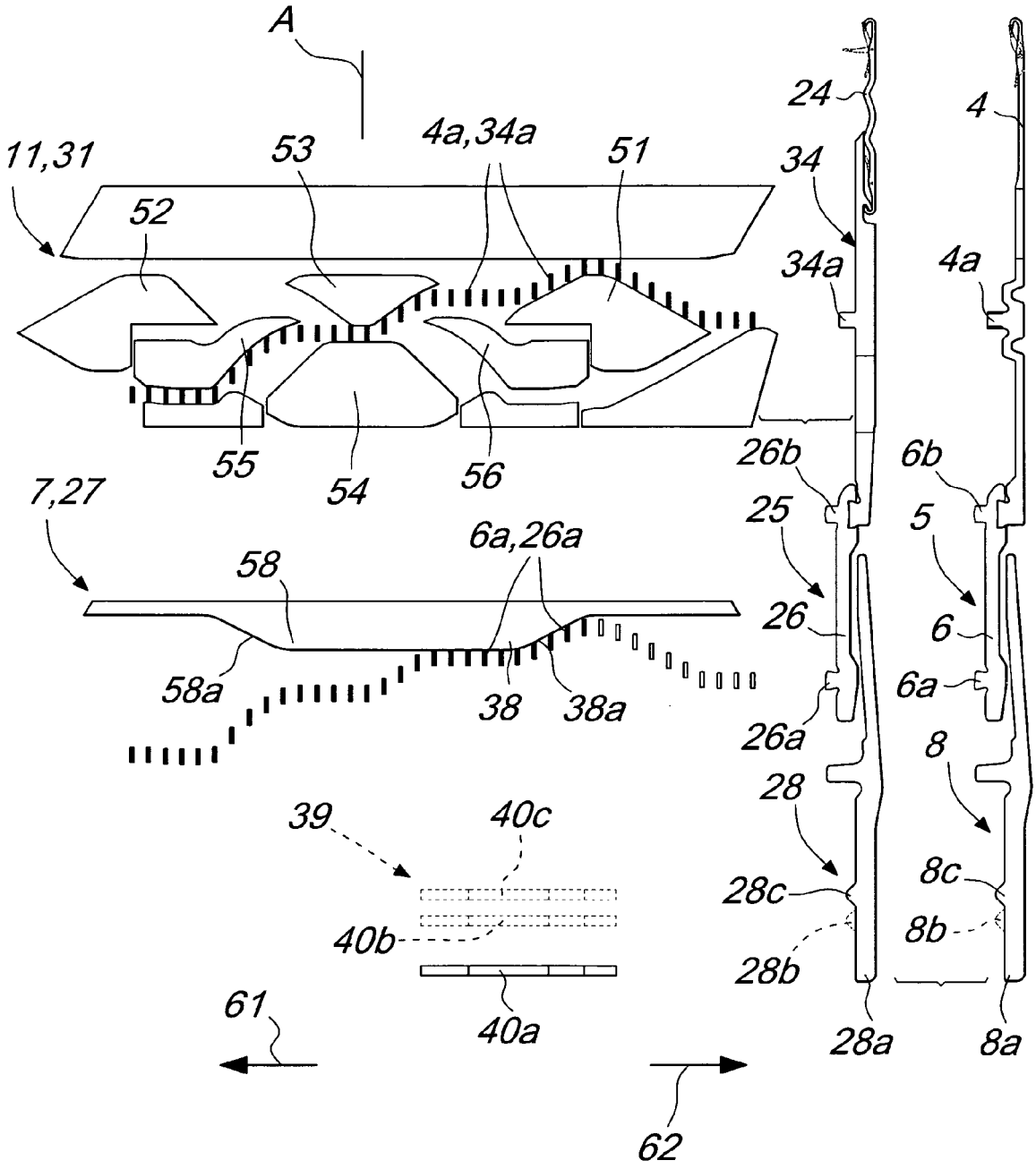
FIG. 6 is a view of the same embodiment of the set of actuation cams of the needle actuation elements and optionally of the needles shown in FIG. 5, marking another possible path followed by the heels of the needle actuation elements and optionally of the needles at a feed or drop of the machine.

FIGS. 5 and 6 illustrate, by way of example, a possible embodiment of a portion of the set of actuation cams 7, 27, 11, 31 arranged around the needle cylinder 2 of a single-cylinder circular machine or around the lower needle cylinder 22 of a double-cylinder circular machine, at a feed or drop, the position of which is indicated by the line A, in particular at the feed or drop A that can be used during the actuation of the needle cylinder 2, 22 with a reciprocating motion about its own axis 2*a*, 22*a*.

Among the needle actuation cams 11 or slider actuation cams 31 shown, the following are designated: a lifting cam 51 for the rotary motion of the needle cylinder 2, 22 in one direction, a lifting cam 52 for the rotary motion of the needle cylinder 2, 22 in the opposite direction, a central cam 53, a central complementary cam 54, a knockover cam 55 for the motion of the needle cylinder 2, 22 in one direction, a knockover cam 56 for the rotary motion of the needle cylinder 2, 22 in the opposite direction.

Among the connecting element actuation cams 7, 27 shown, the following are designated: a retraction or lowering cam 38 for the rotary motion of the needle cylinder 2, 22 in one direction with a corresponding portion 38*a* which can be engaged by the movable heel 6*a*, 26*a* and a retraction or lowering cam 58 for the rotary motion of the needle cylinder 2, 22 in the opposite direction with a corresponding portion

58*a* which can be engaged by the movable heel 6*a*, 26*a*. These two cams 38, 58, in the illustrated embodiment, are formed monolithically, but they might also be provided as two separate cams.

FIG. 5 illustrates the paths followed by the heel 4*a* of the needle 4 or by the heel 34*a* of the slider 34 and by the movable heel 6*a*, 26*a* of the connecting element 6, 26 when the corresponding needle must not be moved to knit at the feed or drop A being considered. The direction of rotation of the needle cylinder 2, 22 with respect to the cams is indicated by the arrow 61. In practice, the movable heel 6*a*, 26*a* is moved or kept in the inactive position and therefore, after the heel 4*a*, 34*a* of the needle 4 or of the slider 34 has engaged the lifting cam 51, the movable heel 6*a*, 26*a* of the connecting element 6, 26 does not engage the portion 38*a* of the retraction cam 38 and therefore the heel 4*a*, 34*a* of the needle 4 or of the slider 34 passes above the central cam 53 and does not engage the knockover cam 55.

FIG. 6 illustrates the paths followed by the heel 4*a* of the needle 4 or by the heel 34*a* of the slider 34 and by the movable heel 6*a*, 26*a* of the connecting element 6, 26 when the corresponding needle 4, 24 must be moved to knit at the feed or drop A being considered. The direction of rotation of the needle cylinder 2, 22 with respect to the cams is again indicated by the arrow 61. In practice, after the heel 4*a*, 34*a* of the needle 4 or of the slider 34 has engaged the lifting cam 51, the movable heel 6*a*, 26*a* of the connecting element 6, 26, moved into the active position by the intervention of the presser 40*a* or of one of the other pressers 40*b*, 40*c*, engages the portion 38*a* of the retraction cam 38 and therefore the heel 4*a*, 34*a* of the needle 4 or of the slider 34 engages first the central cam 53 and then the knockover cam 55 and the corresponding needle 4, 24 forms knitting at the feed A being considered.

In FIGS. 5 and 6, in order to distinguish the active position from the inactive position of the heels 6*a*, 26*a* of the connecting elements 6, 26, the heels 6*a*, 26*a* in the active position have been shaded, while the heels in the inactive position have not been shaded.

Pressers similar to the pressers 40*a*, 40*b*, 40*c* can be provided at the portion 58*a* of the lowering cam 58, so as to obtain an operating condition which is similar to the one described above also when the needle cylinder 2, 22 is actuated with a rotary motion about its own axis 2*a*, 22*a* with respect to the actuation cams in the opposite direction, i.e., in the direction indicated by the arrow 62.

It should be noted that with the machine according to the invention it is possible to cause the transfer of the movable heel 6*a*, 26*a* of the connecting element 6, 26 from the inactive position to the active position in any position in which it might be along the axial slot 3, 23 of the needle cylinder 2, 22 and thus cause the engagement or lack of engagement of said movable heel 6*a*, 26*a* with corresponding actuation cams, causing a variation of the path followed by the fixed heel 4*a*, 34*a* of the needle 4 or of the slider 34 that is associated therewith. In this manner there is no need for movable cams and therefore the problems observed with reference to the presence of said movable cams are solved.

The solutions described above with reference to the lower needle cylinder in a double-cylinder circular knitting machine for hosiery can also be adopted for the upper needle cylinder by providing, as mentioned above, selectors, connecting elements and sliders like the ones described with reference to the lower needle cylinder, as well as corresponding actuation cams and pressers which are similar to the ones described with reference to the lower needle cylinder, except for differences imposed by the different operating condition, which is well-known to the person skilled in the art, and taking into account the fact that the elements related to the upper needle cylinder are inverted with respect to the elements related to the lower needle cylinder.

In practice it has been found that the machine according to the invention fully achieves the intended aim, since by safely ensuring the engagement of the movable heel of the connecting elements in the active position with the extraction cams and the retraction cams it ensures precise operation even at high operating speeds and in the presence of vibration.

Another advantage of the machine according to the invention is that it allows to reduce or even eliminate the movable cams in the set of slider or needle actuation cams despite allowing to execute substantially all the kinds of knitting that can be performed currently with circular knitting machines for hosiery of the traditional type.

The machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Applications no. MI2006A000628 and MI2006A001378, from which this application claims priority, are incorporated herein by reference.

What is claimed is:

1. A circular knitting machine for hosiery or the like, comprising at least one needle cylinder which has a vertical axis and has, on its lateral surface, a plurality of axial slots, each of which accommodates a needle and a needle actuation element, wherein said actuation element comprises at least one connecting element, which is provided, on its side directed toward the outside of the needle cylinder, with at least one movable heel; said connecting element being able to oscillate on a radial plane of the needle cylinder for the transfer of said movable heel from an active position, in which said movable heel protrudes radially from the corresponding axial slot of the needle cylinder to engage corresponding connecting element actuation cams which face the lateral surface of the needle cylinder and define paths which can be followed by said movable heel, in the active position, as a consequence of the actuation of the needle cylinder with a rotary motion about its own axis with respect to said connecting element actuation cams, to an inactive position, in which said movable heel is contained in said axial slot of the needle cylinder so as to not engage said connecting element actuation cams, and vice versa; said connecting element actuation cams comprising at least one extraction cam or one retraction cam, which has a portion whose profile is inclined with respect to an ideal plane which is perpendicular to the axis of the needle cylinder and can be engaged by said movable heel in the active position; extraction means being provided which act on said connecting element to transfer its movable heel from said inactive position to said active position and to keep said movable heel of the connecting element in said active position substantially over the entire extension of said portion of the extraction cam or of the retraction cam.

2. The machine according to claim 1, wherein said needle actuation element comprises a selector which has a portion which lies between said connecting element and the bottom of the axial slot of the needle cylinder in which it is accommodated; said selector being able to oscillate on a radial plane of the needle cylinder in order to produce the transfer of said movable heel of the connecting element from said inactive position to said active position; said extraction means acting on command on said selector for its oscillation on said radial plane to actuate the transfer of said movable heel of said connecting element from said inactive position to said active position.

3. The machine according to claim 2, wherein said selector lies with said portion thereof between said connecting element and the bottom of the axial slot of the needle cylinder in which it is accommodated in any position which can be assumed by said connecting element during the operation of the machine.

4. The machine according to claim 2, wherein said extraction means comprise an extraction element which faces the lateral surface of the needle cylinder and acts, by means of said selector, on said connecting element to keep said movable heel of the connecting element in said active position substantially along the entire extension of said portion of the extraction cam or retraction cam.

5. The machine according to claim 4, wherein said extraction element comprises at least one presser which faces the lateral surface of the needle cylinder and can engage said selectors for their transfer or retention in the position that corresponds to the active position of said movable heel of the connecting element.

6. The machine according to claim 5, wherein said presser can move on command with respect to the needle cylinder in order to pass from an activation position, in which it interferes with said selectors, to a deactivation position, in which it does not interfere with said selectors.

7. The machine according to claim 6, wherein said presser can move on command along a radial direction with respect to the needle cylinder in order to pass from said activation position to said deactivation position.

8. The machine according to claim 2, wherein said connecting element is pivoted to the longitudinal end of the needle which lies opposite the tip or head of the needle about a pivoting axis which is perpendicular to said radial plane; said connecting element being able to oscillate about said pivoting axis with respect to said needle for the transfer of said movable heel from said active position to said inactive position or vice versa.

9. The machine according to claim 2, wherein said needle has, in an intermediate region of its longitudinal extension, a fixed heel which protrudes radially from the corresponding axial slot of the needle cylinder and can engage needle actuation cams which face the lateral surface of the needle cylinder and define paths which can be followed by said fixed heel as a consequence of the actuation of the needle cylinder with a rotary motion about its own axis with respect to said needle actuation cams.

10. The machine according to claim 7, wherein said needle actuation element comprises an intermediate element, which is arranged between said connecting element and the needle, arranged in a same axial slot of the needle cylinder; said connecting element being pivoted to said intermediate element about a pivoting axis which is perpendicular to said radial plane, said connecting element being able to oscillate about said pivoting axis with respect to said intermediate element for the transfer of said movable heel from said active position to said inactive position or vice versa.

11. The machine according to claim 10, wherein the pivoting between said needle or intermediate element and said connecting element is constituted by a protrusion which lies on the side of said needle or of said intermediate element which is directed away from the bottom of the axial slot of the needle cylinder in which it is accommodated and by a seat which rotatably accommodates said protrusion and is formed in said connecting element.

12. The machine according to claim 10, wherein said connecting element has, at its end connected to said needle or to said intermediate element, a second heel which protrudes radially toward the outside of the needle cylinder.

13. The machine according to claim 1, constituted by a double-cylinder machine with a lower needle cylinder and an upper needle cylinder arranged above and coaxially with respect to said lower needle cylinder; a plurality of mutually aligned axial slots being formed on the lateral surface of the lower needle cylinder and on the lateral surface of the upper needle cylinder; a needle actuation element being accommodated in each of the axial slots of the lower needle cylinder and of the upper needle cylinder; said needle actuation element comprising, at least for the lower needle cylinder:

a slider which constitutes said intermediate element and is provided, proximate to one of its longitudinal ends, with means for engaging the head of a needle;

said connecting element pivoted to the longitudinal end of said slider which lies opposite the end that can engage the needle;

said selector having a portion which protrudes between said connecting element and the bottom of the axial slot of the needle cylinder, in which it is accommodated, in any position which can be assumed by said connecting element during the operation of the machine; said selector being able to oscillate on a radial plane of the needle cylinder in order to actuate the transfer of said movable heel of the connecting element from said inactive position to said active position.

14. The machine according to claim 13, wherein said slider has, in an intermediate region of its longitudinal extension, a fixed heel which protrudes radially from the corresponding axial slot of the needle cylinder and can engage slider actuation cams which face the lateral surface of the needle cylinder and form paths which can be followed by said fixed heel as a consequence of the actuation of the needle cylinder with a rotary motion about its own axis with respect to said slider actuation cams.

15. The machine according to claim 13, wherein the actuation elements of the needles arranged in the axial slots of the upper needle cylinder are provided substantially like the actuation elements of the needles arranged in the axial slots of the lower needle cylinder.

16. The machine according to claim 13, wherein said slider can oscillate on a radial plane of the needle cylinder for the engagement of the head of the needle or the release of the head of the needle by its longitudinal end which lies opposite the longitudinal end connected to said connecting element.

17. The machine according to claim 12, wherein said second heel of the connecting element can be pressed toward the bottom of the axial slot in order to produce the oscillation of said slider on said radial plane in the direction which moves its longitudinal end directed toward the needle away from the bottom of the axial slot of the needle cylinder in which it is accommodated.

18. The machine according to claim 13, wherein said selector has, in a region of its longitudinal extension which is spaced from its portion which is interposed between the bottom of the axial slot in which it is accommodated and said connecting element, at least one region which can be pressed toward the bottom of the axial slot in order to cause the oscillation of the selector and consequently the transfer of said movable heel of the connecting element from the inactive position to the active position.

* * * * *